United States Patent [19]

Clements et al.

[11] Patent Number: 4,788,816

[45] Date of Patent: Dec. 6, 1988

[54] TEXTURIZED SYNTHETIC YARNS

[75] Inventors: Larry R. Clements, Lyman; Paul W. Eschenbach, Moore, both of S.C.

[73] Assignee: Milliken Research Corporation, Spartanburg, S.C.

[21] Appl. No.: 161,308

[22] Filed: Feb. 23, 1988

Related U.S. Application Data

[60] Continuation of Ser. No. 944,570, Dec. 22, 1986, abandoned, which is a division of Ser. No. 850,160, Apr. 10, 1986, Pat. No. 4,674,273.

[51] Int. Cl.[4] ..... D02G 1/16; D02G 3/34

[52] U.S. Cl. ..... 57/208; 57/207; 57/239; 57/246; 57/908

[58] Field of Search ..... 57/207, 208, 239, 908, 57/243, 248, 288–290, 295, 350, 351, 245, 246, 247

[56] References Cited

U.S. PATENT DOCUMENTS

| | | | |
|---|---|---|---|
| 3,199,281 | 8/1965 | Maerov et al. | 57/908 X |
| 4,228,640 | 10/1980 | Talbot | 57/908 X |
| 4,365,466 | 12/1982 | Horiuchi et al. | 57/908 X |
| 4,464,894 | 8/1984 | Leininger | 57/908 X |
| 4,467,594 | 8/1984 | Eschenbach | 57/208 X |
| 4,567,720 | 2/1986 | Price | 57/208 X |

*Primary Examiner*—Donald Watkins

*Attorney, Agent, or Firm*—H. William Petry; Earle R. Marden

[57] ABSTRACT

Method to produce a spun-like textured yarn comprised of one yarn which is substantially fully oriented and the other yarn is partially oriented. The method involves plying the yarns in the draw zone before being pre-textured. The ply point of the plied yarns is located above the entrance to the heater in the draw zone.

3 Claims, 1 Drawing Sheet

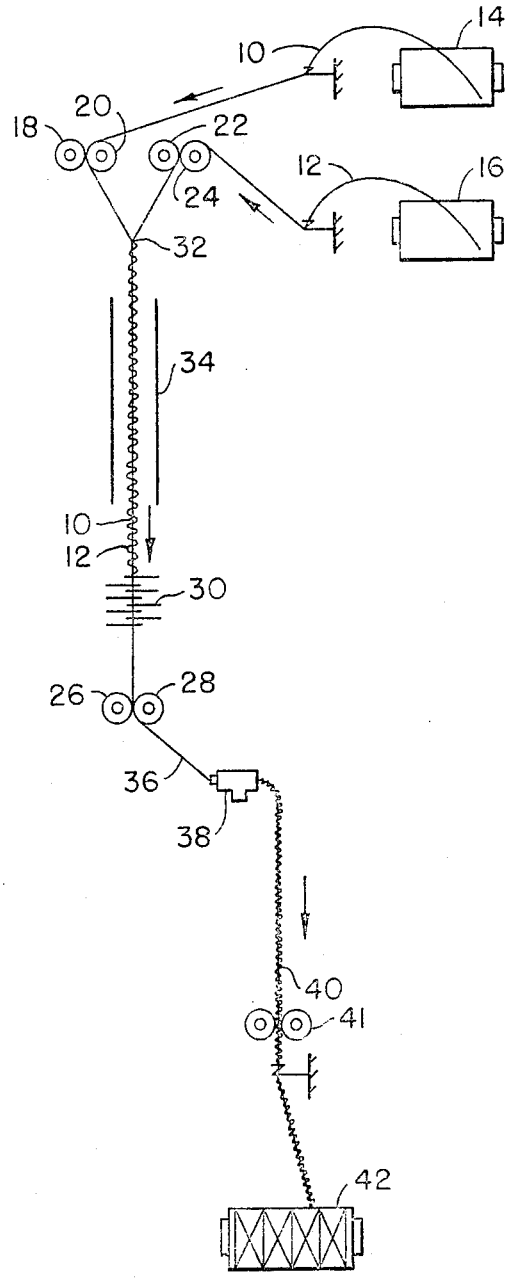
14
10
20
18
22
12
16
24
32
34
10
12
30
26
28
36
38
40
41
42

TEXTURIZED SYNTHETIC YARNS

This application is a continuation of U.S. patent application Ser. No. 944,570 filed Dec. 22, 1986, now abandoned, which in turn is a division of U.S. patent application Ser. No. 850,160 filed Apr. 10, 1986, now U.S. Pat. No. 4,674,273 granted June 23, 1987.

This invention relates generally to the treatment of continuous filament, synthetic yarn to produce a spun-like yarn. In particular, the invention is directed to a combination of a plurality of continuous filament, synthetic yarns which are drawn, false twisted and air textured to produce a spun-like composite yarn having a non-uniform appearance.

It is therefore an object of the invention to provide a method to produce a non-uniform spun-like yarn from a plurality of continuous filament, synthetic, partially oriented yarns.

Other objects of the invention will become readily apparent as the specification proceeds to describe the invention with reference to the accompanying drawing which represents schematically the new and novel process to produce a spun like yarn.

Looking now to the drawing, a pair of yarns 10 and 12 are supplied, respectively, from yarn packages 14 and 16 to the feed rolls 18 and 20 and 22 and 24. The yarn 10 is preferably a DuPont 200 Denier/68 filament 242 T polyester yarn which is supplied to the driven rolls 18 and 20 to deliver yarn 10 at a rate of 200 meters/minute. The yarn 12 is preferably a DuPont 170 Denier/100 filament 56 T polyester yarn which is delivered at a rate of 185 meters/minute by the rolls 22 and 24.

Between the rolls 18, 20, 22, 24 and the rolls 26 and 28, the yarns 10 and 12 are plied, crimped and drawn. The rolls 26 and 28 are driven at a rate to supply yarn at 264 meters/minute. Upon starting of the device, the yarns 10 and 12 are brought together at the crimping apparatus 30, schematically represented as friction discs, and when the crimping apparatus is started up, it twists one yarn around the other until the twist equilibrium or ply point 32 is reached just above the heater 34.

While the yarns 10 and 12 are being crimped, they are also being drawn between the rolls 18, 20, 22, 24 and the rolls 26, 28. The primary heater 34 is operating at a temperature of approximately 220° C. to heat the yarns 10 and 12 as they pass therethrough. The yarns 10 and 12 are partially oriented and therefore have a nominal denier (the fully oriented denier) to which it can be drawn to. The nominal denier for the yarn 10 is 150 and for the yarn 12 is 100. Then, the nominal draw ratio for yarn 10 is 200/150 or 1.333 and for the yarn 12 is 170/100 or 1.70. It can be seen that the actual draw ratio for the yarn 10 is 264/200 or 1.32 and for the yarn 12 is 264/185 or 1.43. The composite yarn 36 is therefore comprised of a yarn 10 which is substantially fully oriented and a yarn 12 which is partially oriented. In the preferred form of the invention, the draw ratio of the yarn 12 is 73% of the nominal.

The draw ratios above described are independently adjustable and are adjusted to provide different levels of tension in the yarns 10 and 12. This causes the yarn with the higher tension to remain relatively straight while the second yarn (looser tension) wraps around the first yarn. The wrapping yarn therefore is drawn more causing it to be longer than the core yarns when they are untwisted by the crimping apparatus 30 (false twister). Therefore, the yarn 12 is wrapped around the yarn 10.

The composite yarn 36 from the crimping apparatus 30 is overfed to the air jet 38 so that the filaments of the yarn 36 are commingled to lock in the loops formed by the yarn 12 in the air jet 38 to provide the spun-like yarn 40 which is taken upon the package 42. It has been found that the best loop formation in the air jet 38 is achieved when the pressure of air supplied to the jet is approximately 100 p.s.i. The yarn 40 from the jet 38 is delivered by the rolls 41 at a speed of 248 meters/minute where it is taken up at a speed of 254 meters/minute. It should be noted that the composite yarn 36 is not heated to heat-set same after being forwarded by the draw rolls 26, 28.

The herein yarn treatment method provides a spun-like synthetic yarn which has the hand and non-uniformity found in yarns made from staple fibers. The fabric made therefrom has the quality and appearance, without the cost, of a fabric knitted or woven from a spun yarn.

Although the preferred embodiment has been described, it is contemplated that changes may be made without departing from the scope or spirit of the invention and it is desired that the invention be limited only by the claims.

We claim:

1. A spun-like composite yarn comprising: a plurality of commingled, drawn and textured yarns, one of said yarns being substantially fully oriented and another of said yarns being partially oriented, said fully oriented and said partially oriented yarn being air entangled with the partially oriented yarn being in loops around the fully oriented yarn, said spun-like composite yarn being nonheat-set after air entanglement.

2. The yarn of claim 1 wherein said partially oriented yarn is drawn approximately 73% of its nominal value.

3. The yarn of claim 2 wherein said commingled yarns are substantially 100% polyester

* * * * *